US006875312B2

(12) United States Patent
Lepomäki et al.

(10) Patent No.: US 6,875,312 B2
(45) **Date of Patent: *Apr. 5, 2005**

(54) METHOD FOR FLUIDISATION OF PULP FLOW IN THE HEADBOX OF A PAPER MACHINE OR SUCH AND CONTROL EQUIPMENT USED IN THE FLUIDISATION

(75) Inventors: Hannu Lepomäki, Laukaa (FI); Hannu Karema, Jyväskylä (FI); Markku Kellomäki, Haapaniemi (FI); Maarit Tukiainen, Säynätsalo (FI)

(73) Assignee: Metso Paper, Inc., Helsinki (FI)

( * ) Notice: Subject to any disclaimer, the term of this patent is extended or adjusted under 35 U.S.C. 154(b) by 59 days.

This patent is subject to a terminal disclaimer.

(21) Appl. No.: 10/297,890

(22) PCT Filed: Jun. 12, 2001

(86) PCT No.: PCT/FI01/00554

§ 371 (c)(1),
(2), (4) Date: Apr. 8, 2003

(87) PCT Pub. No.: WO01/96658

PCT Pub. Date: Dec. 20, 2001

(65) Prior Publication Data

US 2003/0155093 A1 Aug. 21, 2003

(30) Foreign Application Priority Data

Jun. 13, 2000 (FI) ..... 20001405

(51) Int. Cl.[7] ..... D21F 1/00; D21F 11/00

(52) U.S. Cl. ..... 162/216; 162/259; 162/343; 162/336

(58) Field of Search ..... 162/216, 259, 162/343, 336

(56) References Cited

U.S. PATENT DOCUMENTS

| | | | | |
|---|---|---|---|---|
| 4,376,014 | A | 3/1983 | Bergstrom | |
| 5,183,537 | A | 2/1993 | Hergert et al. | |
| 2003/0159792 | A1 * | 8/2003 | Lepomaki et al. | 162/343 |

FOREIGN PATENT DOCUMENTS

| | | |
|---|---|---|
| FI | 69330 | 9/1985 |
| FI | 870705 | 10/1990 |
| WO | WO 01/21885 A1 | 3/2001 |
| WO | WO 01/96658 A1 | 12/2001 |

OTHER PUBLICATIONS

Search Report in Finnish Priority Application No. 20001405.

International Search Report in International Patent Application No. PCT/FI01/00554.

International Preliminary Examination Report in International Patent Application No. PCT/FI01/00554.

Preliminary Amendment and Substitute Specification from U.S. Appl. No.: 10/088,714.

* cited by examiner

*Primary Examiner*—Mark Halpern
(74) *Attorney, Agent, or Firm*—Stiennon & Stiennon

(57) ABSTRACT

A method for fluidisation of a pulp flow in the headbox of a paper machine or such. The characteristics of the pulp flow are affected in the headbox's fluidiser (14) in one step only, whereby the height ($h_1$) of the step is at least equal to the average fibre length, and after the fluidiser (14) the biggest permissible step expression in the flow channel in direction z is smaller than the average fibre length.

16 Claims, 13 Drawing Sheets

METHOD FOR FLUIDISATION OF PULP FLOW IN THE HEADBOX OF A PAPER MACHINE OR SUCH AND CONTROL EQUIPMENT USED IN THE FLUIDISATION

CROSS REFERENCES TO RELATED APPLICATIONS

This application is a U.S. national stage application of International Application No. PCT/FI01/00554, filed Jun. 12, 2001, and claims priority on Finnish Application No. 20001405 filed Jun. 13, 2000, the disclosures of both of which applications are incorporated by reference herein.

BACKGROUND OF THE INVENTION

The invention concerns a method for fluidisation of pulp flow in the headbox of a paper machine or such and control equipment used in the fluidisation.

The making of paper of a good quality and a stable production process make high demands on the headbox of the paper machine. In particular, a headbox meeting qualitative and productive requirements is expected to be able to produce a homogenous and trouble-free lip discharge.

Various applications in operation and further refinement processes make high qualitative demands on paper and board products. In practice, these demands concern the structural, physical and visual characteristics of the products. In order to achieve characteristics suitable for each individual purpose the production processes are optimised at each time for a certain working range, which sets limits usually also limiting the quantity of production. Thus, a product of the desired kind can be made only in a narrow working range of the production process.

Due to the restrictions may be the working range it is very difficult to carry out such changes in the process, which aim at increasing the production and at improving the quality of the product. Significant changes usually require long-range research and technological development. Process changes desirable for an increased productivity of the manufacturing process are e.g. new techniques having to do with an increased machine speed and a minimised use of water (increased web formation consistency).

In order to make paper of a good quality efforts are made to prevent various disturbances, such as vortexes and consistency streaks, from escaping from the headbox. Such disturbance may occur e.g. in connection with fluidisation (a strong geometrical change) and in the output ends of the pipes of the turbulence generator (disturbances from pipe walls, such as vortexes and consistency and speed profiles). For this reason, 1) fluidisation with small geometrical steps and
2) a low pipe-specific flow rate have typically been used in the headbox.

It follows from a low flow rate that the average residence time of the fibre pulp in the headbox after fluidisation is too long as regards avoidance of re-flocculation. Thus, the fibre pulp will now discharge from the headbox in the fluidised state required for a good formation. To improve fluidisation, lamellas have in fact been introduced for use in the headbox. These lamellas are mounted in the lip channel and they bring about more friction surface in the channel. However, the most significant fluidisation-promoting effect of the lamellas relates to their tip turbulences. Although these turbulences are advantageous for the fluidisation, they will cause coherent flow structures in the flow, which will weaken slowly, but which can be seen even in the produced paper. In practice, the added friction surface brought about by lamellas and the resulting increased yield of boundary-layer turbulence are not sufficient to fluidise the flow. However, with the aid of friction surfaces in flow channels and with the aid of boundary-layer turbulence it is possible to maintain the strongly fluidised state brought about in the turbulence generator. An incomplete (cautious) fluidisation carried out in many stages leads to a more disadvantageous floc structure than fluidisation carried out successfully in one go and based on a controlled residence time.

SUMMARY OF THE INVENTION

The fluidisation of pulp flow according to the invention in the headbox of a paper machine or a board machine or such is different from state-of-the-art solutions in that according to the invention fluidisation is carried out only once in one stage in each pipeline of the headbox's turbulence generator. Thus, each pipeline includes only one fluidisation element. When the fluidisation has been carried out effectively, the flow is accelerated and the fluidisation level is maintained by using lamellas and suitable flow surfaces. By accelerating the flow the residence time of the pulp in the headbox after the fluidisation point is kept as short as possible, so that the fluidisation level remains good also as the pulp arrives at the formation wire, e.g. into the jaw between the formation wires of a jaw former. According to the invention, the fluidisation can be controlled by a controlled fluidisation element or fluidiser. The fluidisation can can thus be controlled according to the pulp quality and the current run. It is advantageous to use pipe elements of the same type for the different headboxes, whereby the height of the fluidisation step is controlled individually for the headbox in each headbox by controlling the height $H_1$ of the expansion step in the fluidisation element. The fluidisation power, that is, the quantity of energy used for fluidisation, is hereby controlled.

In the headbox structure according to the invention, it has been found that by increasing pipe-specific flows of the headbox's turbulence generator the paper quality is improved and the web formation consistency can be increased. This is possible by generating more turbulence in the fluidiser and thus bringing about a more complete fluidisation than with traditional headbox solutions. The harmful effects of the raised turbulence level are eliminated by limiting the scale of vortex size of the generated turbulence.

Fluidisation means that the flow characteristics of the fibre suspension are made to correspond with the characteristics of the water flow. That is, multi-phase flow behaves like a single-phase flow. Hereby the wood fibres, fillers and fines in the fibre suspension flow will behave like water. Fibre lumps, that is, fibre flocs, are broken up in the fluidisation.

Thus, in the headbox according to the invention fluidisation is carried out only once and its level is hereby higher than with a conventional headbox. The fluidisation is preferably implemented in a rotationally symmetrical pipe expansion. However, the used total pressure energy is not necessarily higher than before, because other fluidisation elements, such as steps at the ends of the turbopipes and the tips of lamellas, are minimised. The fluidisation level and thus the minimum floc size are controlled by choosing the entity formed by the fluidiser primary pipes, step expansion and vortex chamber to produce the desired loss energy. A higher fluidisation level is achieved with an increased energy supply. In the headbox according to the invention, the fluidisation is thus carried out in the turbulence generator in one stage, and thereafter the flow will run smoothly without any steps and with as short a residence time as possible into the lip chamber and exit from the lip chamber on to the formation wire.

BRIEF DESCRIPTION OF THE DRAWINGS

The invention will be described in the following by referring to the figures in the appended drawings and graphic penetrations. The description of the inventive theory is based on the graphic presentations, and the illustration of headbox embodiments of the invention show some advantageous embodiments of the invention, although the intention is not to restrict the invention solely to these.

DESCRIPTION OF THE PREFERRED EMBODIMENTS

Figure 1:
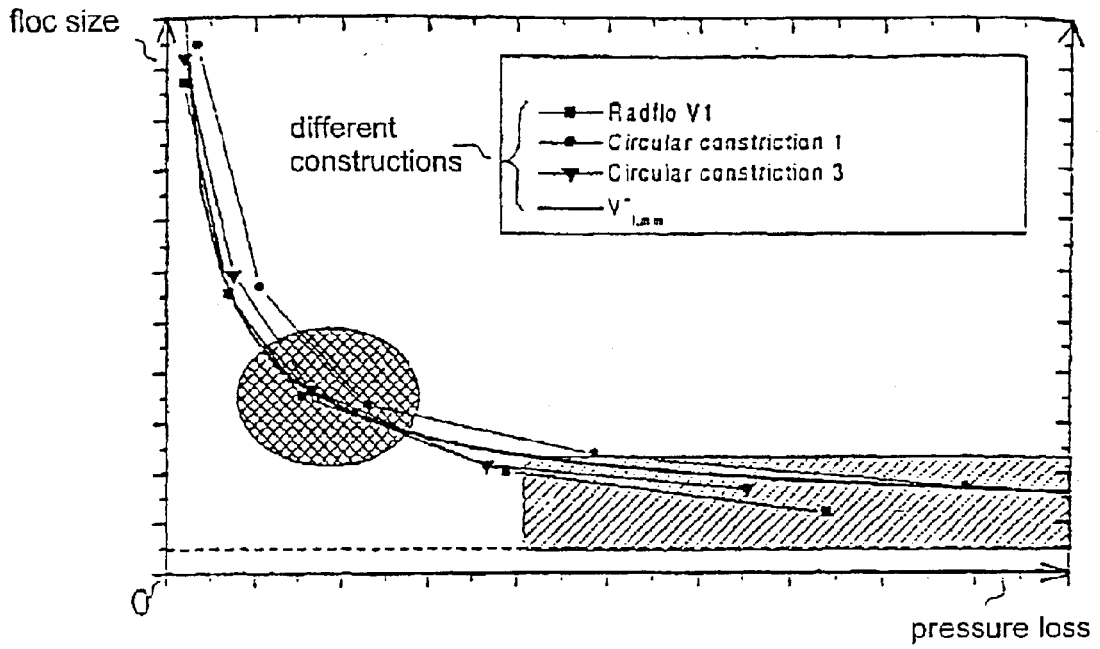
FIG. 1 is a graphic presentation showing the state-of-the-art working range (an oval) and the working range (a rectangle) according to the invention, and the presentation illustrates the fluidisation power of the headbox according to the invention as a function of the fluidiser's loss energy. The vertical coordinates show the floc size while the horizontal coordinates show the pressure loss. The descriptors indicated by various marks present different constructions.

FIG. 1 shows fluidisation (an oval) brought about by the fluidiser of a conventional traditional headbox and the working range (a rectangle) of the headbox according to the invention. The fluidisation element of the headbox according to the invention, e.g. in a tubular turbulence generator, is dimensioned so that the lower limit of its working range corresponds by and large with the optimum of the pressure loss-minimum floc size curve (slope=−1).

Since the minimum floc size is reduced logarithmically as the loss power (the flow rate) increases, almost the same fluidisation level is achieved with flow rates exceeding the dimensioning point corresponding with the above-mentioned optimum. However, due to the higher flow rate, a shorter residence time than before hereby results and thus a better fluidisation level is achieved in the outflow from the headbox. The maximum of the flow rate range is formed by the time needed in the lip channel for disturbance in the lags of turbopipes and lamellas to die out. In the headbox according to the invention, this maximum of the flow rate range is considerably higher than in the traditional headbox, because in connection with the fluidisation a high level of turbulence is brought about, which is kept up the aid of a high flow rate and a small channel size.

Due to the efficient fluidiser a powerful turbulence is achieved in the headbox according to the invention. Such a step is used as fluidiser, the dimension of which is larger than the average fibre length. In this way a vortex size sufficient for breaking flocs is achieved along with an efficient supply of energy. After the fluidizer the turbulence begins dying out promptly. Although vortexes bigger than the average fibre length are needed for breaking the flocs, they will cause quick re-flocculation after the fluidisation.

Figure 2:
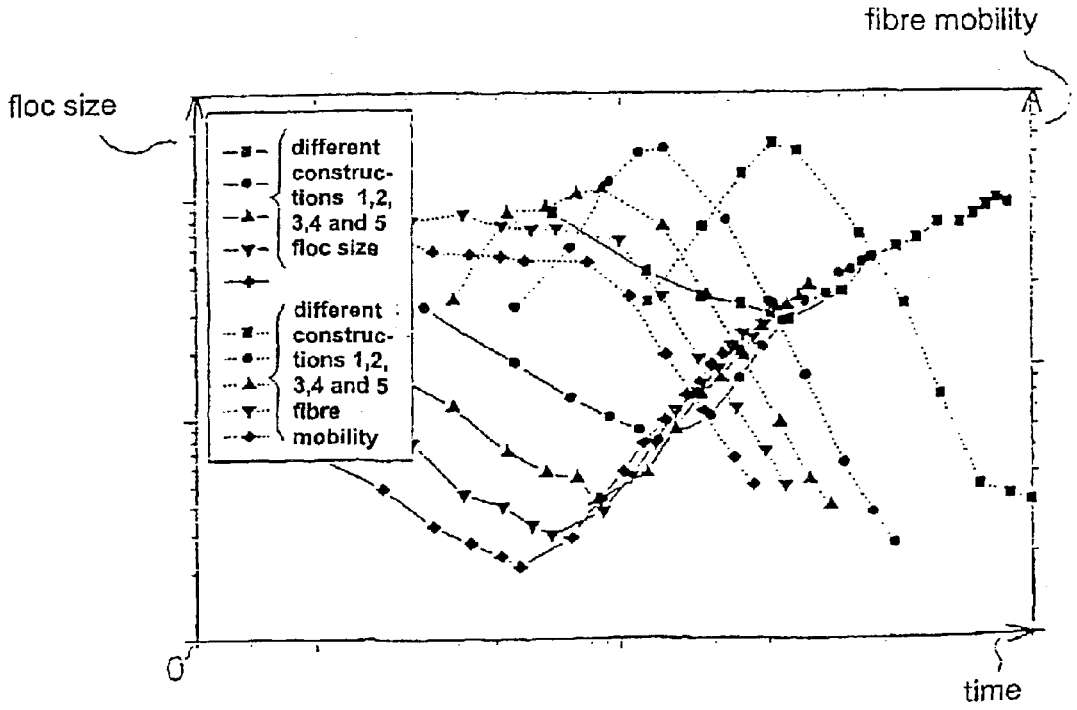
FIG. 2 shows the re-fluidisation process after the fluidiser and the related reduction in fibre mobility. The presentation is hereby read so that the floc size relating to each descriptor shown by a solid lie is read from the vertical axis at the left, while the residence time is read from the horizontal coordinate. The vertical axis at the right shows fibre mobility in relation to the residence time. The presentation is hereby read so that fibre mobility is read from the vertical coordinate at the right and residence time is read from the horizontal coordinate. The descriptors indicated by dashed lines are hereby read. The descriptors illustrate different constructions and thereby different pressure losses. Identical marks relate to the same headbox construction and thus to the same pressure loss.

FIG. 2 shows the re-flocculation process after the fluidiser as well as the related decline in fibre mobility. The presentation is hereby read in such a way that the floc size relating to each descriptor indicated by a solid line can be read from the vertical axis at the left, while the residence time is read from the horizontal coordinate. The vertical axis at the right shows fibre mobility in relation to residence time. The presentation is hereby read in such a way that fibre mobility is read from the vertical coordinate at the right and residence time is read from the horizontal coordinate. The descriptors indicated by dashed lines are hereby read. The descriptors indicated by different marks show different constructions and thus different pressure losses. The same marks relate to the same headbox construction and thus to the same pressure loss. The maximum fibre mobility can be observed at the point where the floc size is at its minimum will each construction.

In the headbox according to the invention, fibre mobility or the fluidisation level is maintained by using the following procedures:

a) the residence time is shortened by a high pipe-specific flow rate, b) the residence time is shortened by accelerating the flow, c) the turbulence scale is diminished by reducing the channel cross-section, d) the residence time is shortened by minimising the distance from the fluidisation element to the wire.

With the aid of wedge-like lammellas 16$a_1$, 16$a_2$ acceleration of the flow is continued and thus the residence time after the automatic fluidisation unit is shortened in the headbox, and reduction of the channel cross-section (control of the scale) is continued in the lip channel part of the headbox. At the same time the share of the wall surface in the lip channel is optimised. With the aid of wall friction turbulence is brought about, which is used to slow down or even to stop the dying out of the high turbulence level brought about in the fluidiser. In addition, the achieved turbulence takes place in the lip channel divided by lamellas on the desired small scale.

In the headbox according to the invention these trouble sources are controlled with the aid of a high turbulence level, that is, fibre mobility, by following the following principles:

a) Control of the scale with the aid of a small channel size reduces the size and strength of the biggest disturbance structures.

b) The high turbulence level brought about in the fluidiser efficiently breaks down coherent structures (e.g., trailing edge structures) smaller than its own scale into a stochastic turbulence. Excessive dying out of the turbulence is controlled with a short residence time, a high flow rate and the yield of boundary-layer turbulence by using lamellas and the flow surfaces of the lip channel to generate turbulence.

c) The high turbulence level quickly levels out consistency streaks from walls at the ends of turbopipes or lamellas.

d) A high Reynolds number, that is, a high pipe flow rate, and acceleration of the flow keep the boundary layers thin and stable.

e) Fluidisation is carried out efficiently only once and the said fluidised state is kept up by the means mentioned above. The disturbances caused by item c) are hereby avoided.

f) The flow is accelerated in the entire part after the fluidiser by using conical lamellas having a reducing thickness.

g) The amplitude of the coherent structures of trailing edges is kept low and the frequency high by using thin and sharp lamella tips.

According to the invention, the characteristics of the pulp flow are affected in the fluidiser 14 of the headbox in one step only, whereby the height $h_1$ of this step is at least equal to the average fibre length, and after the fluidiser 14 the biggest permissible step expansion in the flow channel in the z direction is smaller than the average fibre length.

Figure 3A:
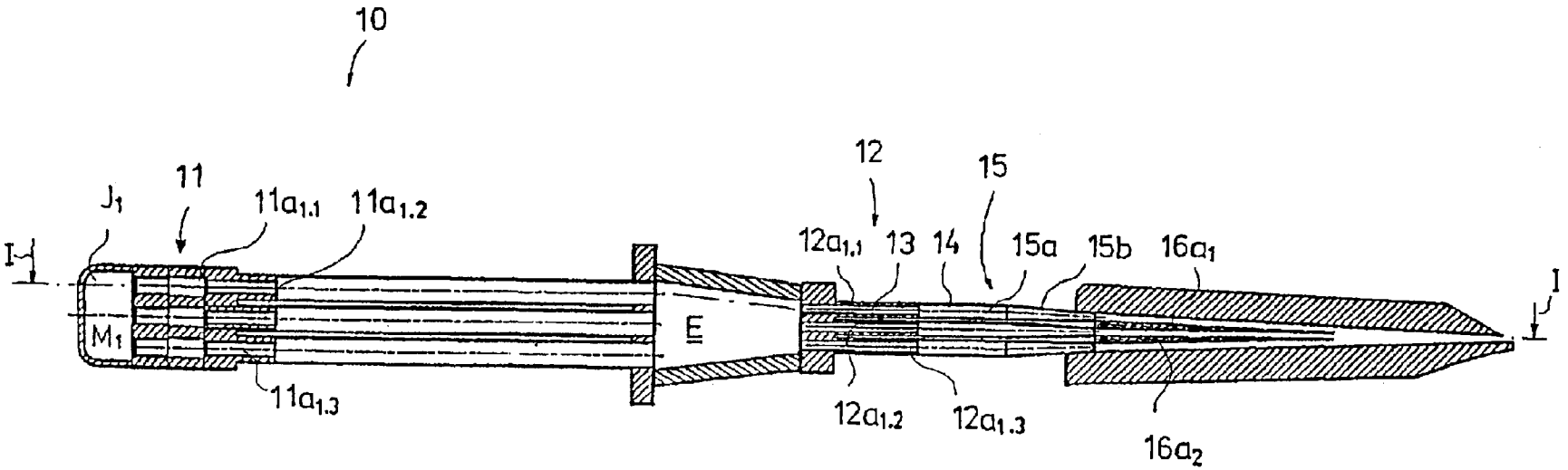
FIG. 3A is a cross-sectional view from the side of the headbox according to the invention.

FIG. 3A shows a side cross-sectional view of the headbox 10 according to the invention for a paper machine or a board machine or such. As is shown in FIG. 3A, and $M_1$ is conducted from bypass manifold $J_1$ through pipes 11$a_{1,1}$, 11$a_{1,2}$ . . . ; 11$a_{2.1}$, 11$a_{2.2}$ . . . of pipe set 11 into an intermediate chamber E and further into a turbulence generator 12. From the turbulence generator 12 the pulp flow is guided into lip cone K and further between formation wires $H_1$ and $H_2$ into a former, preferably a jaw former 20.

Figure 3B:
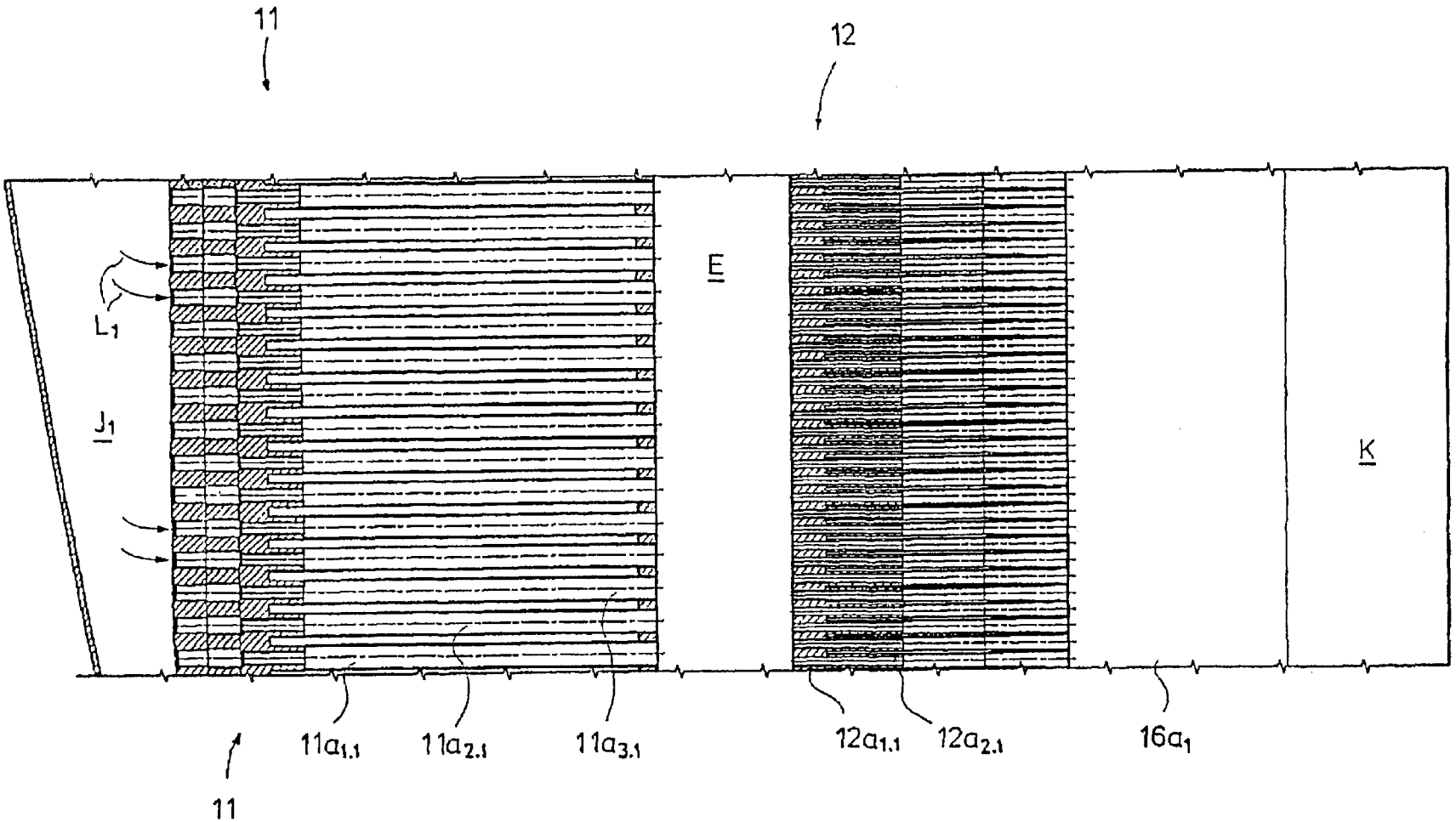
FIG. 3B is a view along sectional line I—I of the headbox according to the invention.
Figure 4:
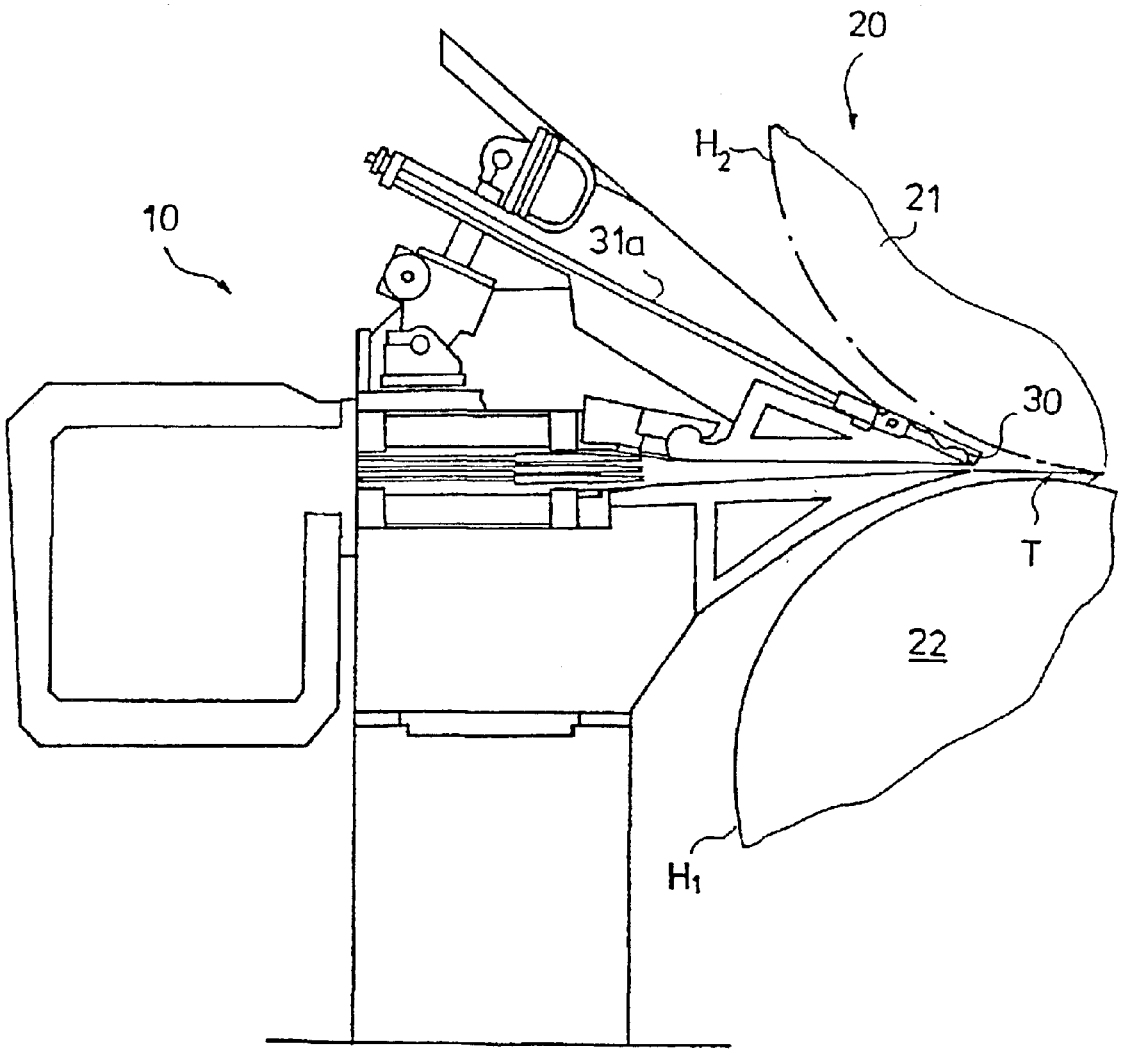
FIG. 4 shows the headbox according to the invention in connection with a jaw former.

FIG. 3B shows a lateral cross-sectional view in accordance with FIG. 3A of headbox 10 along sectional line I—I of FIG. 3A. As is shown in FIG. 3B, a narrowing bypass manifold $J_1$ leads a pulp flow $L_1$ into pipes 11$a_{1.1}$, 11$a_{1.2}$. . . ; 11$a_{2.1}$, 11$_{2.2}$ . . . , 11$a_{3.1}$, 11$a_{3.2}$ . . . of pipe set 11 and further from the pipes of pipe set 11 into intermediate chamber E and further into turbulence generator 12 and past lamellas 16$a_1$, 16$a_2$ into lip cone K and further on to formation wire $H_1$, preferably between formation wires $H_1$ and $H_2$ of jaw former 20, as is shown in FIG. 4.

Figure 3C:
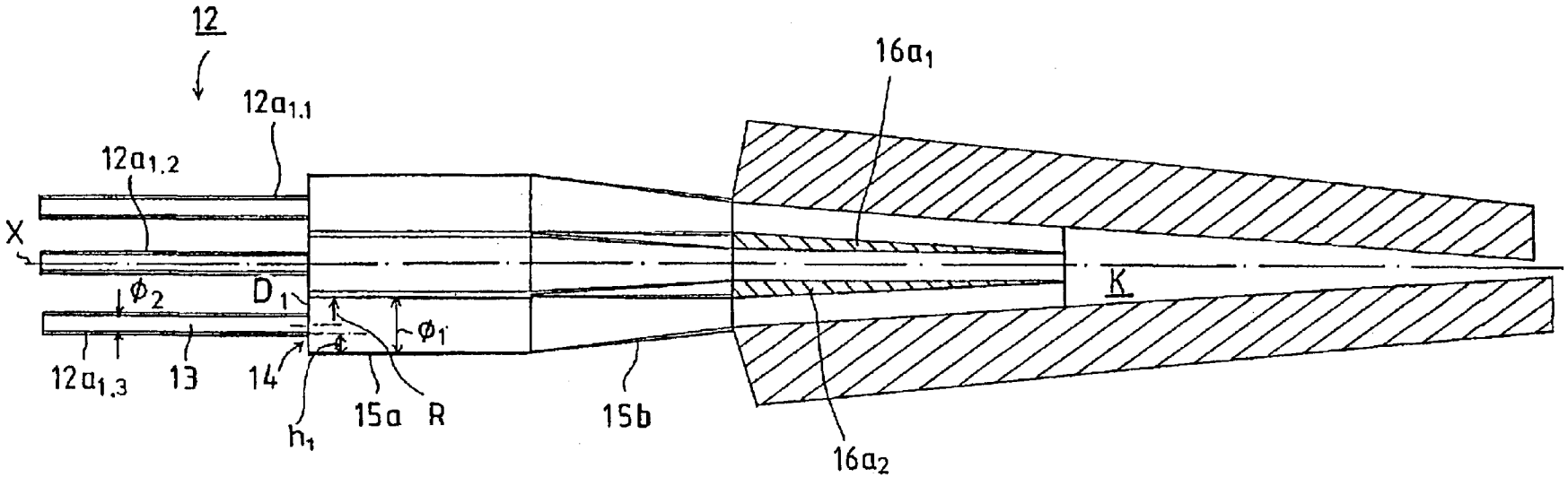
FIG. 3C is a view on a larger scale of the turbulence generator associated with the headbox according to the invention, which indicates a fluidisation element according to the invention.

FIG. 3C shows on a larger scale the turbulence generator 12 and the following structures in the headbox of FIG. 3A. As is shown in FIG. 3C, the pipe 12$a_{1.1}$, 12$a_{1.2}$ . . . ; 12$a_{2.1}$, 12$a_{2.2}$ . . . of each row of pipes of the turbulence generator 12 is formed as follows. Into the intermediate chamber E narrowing in the flow direction a throttling pipe 13 opens, the length of which is at least 150 mm and inner diameter ($\Phi_2$) in the range 10 mm–20 mm. Intermediate chamber E may also have a standard cross-sectional flow area in the flow direction $L_1$. After pipe 13 is the flow direction there is a fluidiser 14, which is formed by a stepped structure with a circular cross-section, which is shown in greater detail in FIG. 6. The height $h_1$ of a step is determined by the difference between the inner diameters of mixing pipe 15$a$ and throttling pipe 13, which is divided by two, that is $$h_1=\Phi_1-\Phi_2/2$$

and step height $h_1$ is at least equal to the average fibre length, preferably more, preferably in a range of 1 mm–12 mm, and most preferably in a range of 1 mm–6 mm. The average fibre length is typically in a range of 1 mm–3 mm, depending on the pulp used. After the fluidiser, that is, the fluidisation element 14, there is a pipe 15 of the turbulence generator, which pipe includes a rotationally symmetrical mixing pipe part 15$a$ no less than 50 mm long and then an acceleration and reshaping part 15$b$, which is used to accelerate the pulp flow and the length of which is no more than 200 mm, so that the intensity of turbulence is sufficient to allow the steps in the outlet opening of pipe 15$b$. The length of lip channel K is chosen so that the flows arriving from pipes 15 will have the time to mix in it, but so that re-flocculation is prevented. The length of lip channel K is chosen within a range of 100 mm–800 mm. The cross-section of pipe 15$a$ turns from circular into a square in pipe 15$b$. The inner diameter $\Phi_1$ of pipe part 15$a$ is in the range 20 mm–40 mm. The ratio $\Phi_1/\Phi_2$ between the inner diameters of pipes 15$a$ and 13 is in the range 1.1–4.0. The flow then comes from pipe 15$b$ of the turbulence generator to reach lamellas 16$a_1$, 16$a_2$ in such a way that between the pipe 12$a_{1.1}$, 12$a_{2.1}$ . . . and lamella 16$a_1$, 16$a_2$ there is no step or it is no more than 2 mm, that is, equal to the thickness of the pipe wall of the turbulence generator. According to the invention, such lamellas 16$a_1$, 16$a_2$ are used, which narrow in a wedge-like fashion in the flow direction and end in a sharp tip, the height $h_2$ of which tip is in the range 0–2 mm, preferably less than 1 mm. Thus, the headbox according to the invention in the turbulence generator includes only one fluidisation point and after this acceleration arrangements and lamella arrangements to maintain the fluidisation level of the flow after the fluidisation point and to minimise the residence time in the headbox before the formation wire $H_1$, $H_2$.

After the fluidisation element 14, the pulp flow speed is accelerated essentially all the time all the way to the lip opening. After the fluidisation element 14 the maximum permissible step expansion in the flow channel in the z direction is less than the average fiber length. The minimum length of pipe 13 of the turbulence generator 12 to 150 mm, the minimum length of the rotationally symmetrical part of pipe 15$a$ is 50 mm and the maximum length of pipe part 15$b$ is 200 mm.

Figure 3D:
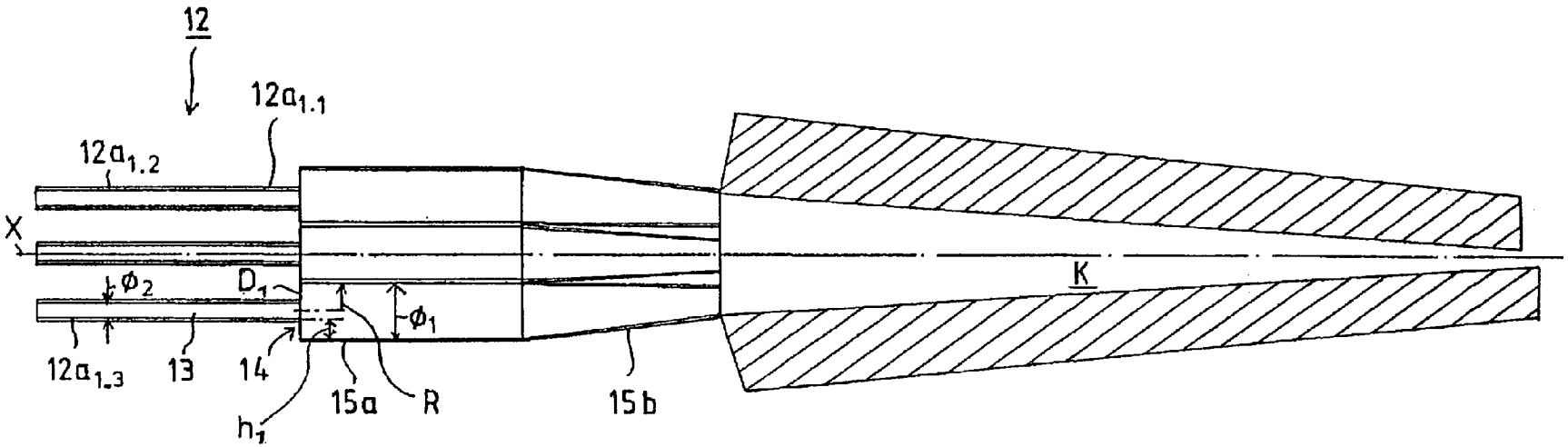
FIG. 3D shows an embodiment of the invention, wherein the fluidisation element, that is, the fluidiser, is located in the turbulence generator, which ends in the lip chamber so that the lip chamber includes no lamellas.

FIG. 3D shows an embodiment of the invention, which differs from the earlier embodiments only in that the headbox includes no lamellas. From the turbulence generator 12 the flow is guided after fluidisation directly into the lip chamber and further on to the formation wire.

FIG. 4 shows a headbox 10 according to the invention in connection with rolls 21 and 22 of former 20. The pulp discharge is conducted from headbox 10 into a jaw T in between wires $H_1$ and $H_2$. Headbox 10 includes a tip lath 30 and spindles 31$a_1$, 31$a_2$. . . controlling it along the tip lath length at different pints of the headbox width. The pulp is conducted from bypass manifold $J_1$ directly into a turbulence generator 12 according to the invention.

Figure 5:
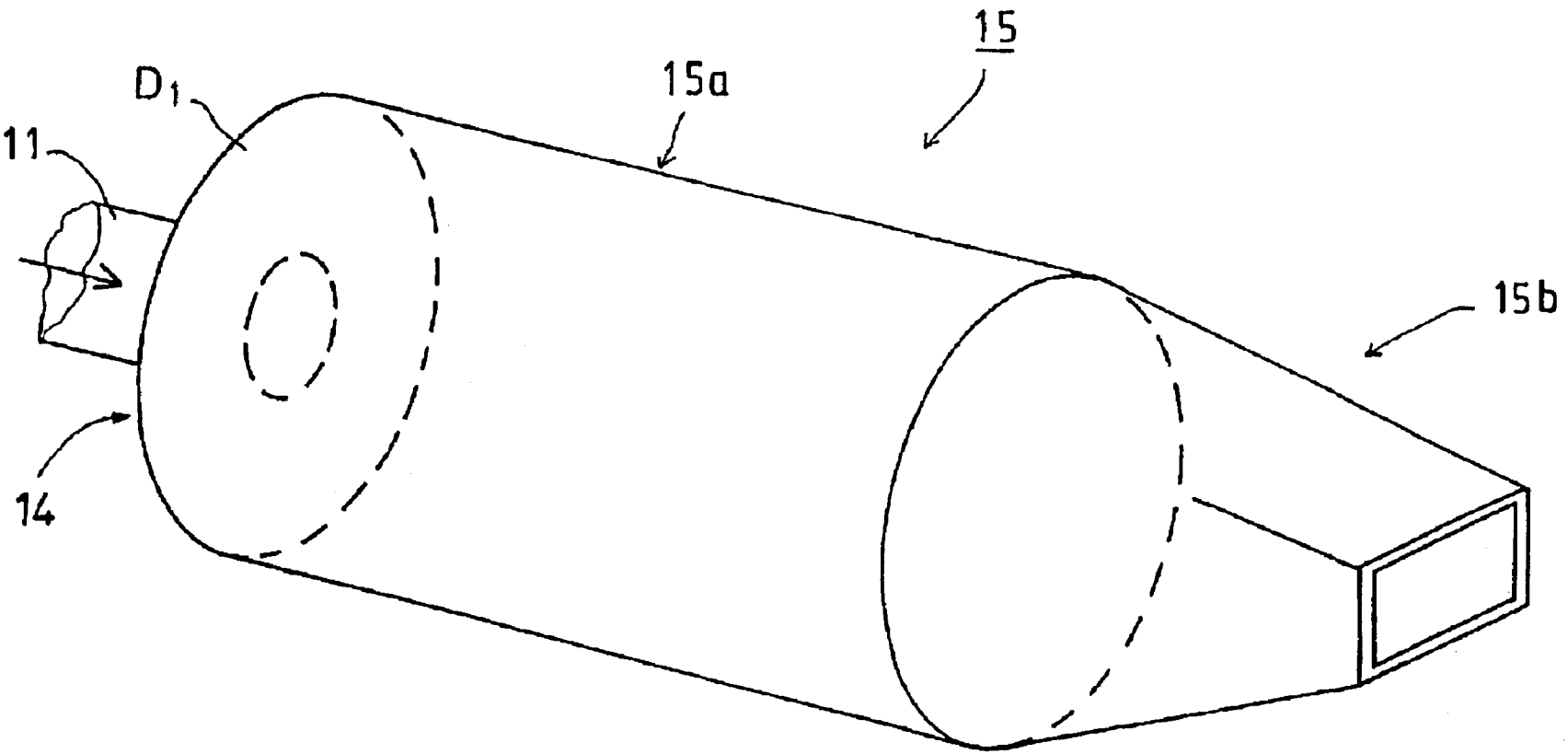
FIG. 5 shows a pipe 15 after the fluidisation element according to the invention, which pipe includes a pipe part 15*a* with a circular cross-section, and next a pipe part 15*b* turning into a rectangular cross-section.

FIG. 5 shows in a headbox according to the invention a turbulence pipe 15 used in its turbulence generator 12, which pipe includes a pipe part 15*a* with a circular cross-section, which ends in a rectangular cross-section 15*b*. The wall thickness is approximately 2 mm. In the circular cross-section the degree of fluidisation is developed to its maximum, and thereafter the flow is accelerated in the pipe part 15*b* in order to minimise the residence time in the headbox. The said pipe part 15*b* is also a so-called reshaping part, wherein the circular cross-section turns into a rectangular cross-section, which is the most advantageous end shape for the pipes of the turbulence generator. As is shown in the figure, a lamella 16$a_1$ narrowing in a wedge-like fashion is located in between the pipe rows 12$a_{1.1}$ and 12$a_{1.2}$ of the turbulence generator, and a second lamella 16$a_2$ narrowing in a wedge-like fashion into lip cone K is located in between the pipe rows 12$a_{1.2}$ and 12$a_{1.3}$ of the turbulence generator.

Figure 6:
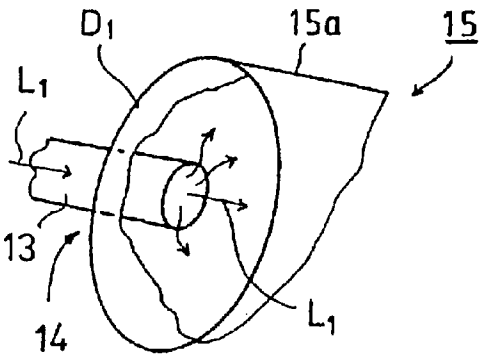
FIG. 6 is an axonometric view of the fluidiser, that is, the fluidisation element, according to the invention.

FIG. 6 shows the fluidisation element 14 or fluidiser according to the invention, which is formed by a pipe expansion. According to the invention, the fluidisation element as shown in the figure after the pipe part 13 includes a channel expansion, that is, a step, which includes a wall structure $D_1$, preferably an annular plate, whose plate plane is at right angles to the longitudinal axis X of pipe 11 and to the flow direction $L_1$ and which annular wall part $D_1$ ends in the inner wall of pipe 15*a,* which has a circular cross-section. The height $h_1$ of the step expansion of fluidisation element 14 is preferably in the range 1–12 mm and most preferably in the range 1 mm–6 mm and it is at least equal to the average fibre length. In the fluidiser shown in FIG. 6, the pulp flow $L_1$ is thus conducted from pipe 13 to a radially expanding point including the annular wall structure $D_1$, which ends in the inner surface of pipe 15*a,* which has a circular cross-section. Under these circumstances, the radially travelling flow is limited by the wall structure $D_1$ and by the pipe's 15*a* inner wall surface, which has a circular cross-section.

Figure 7:
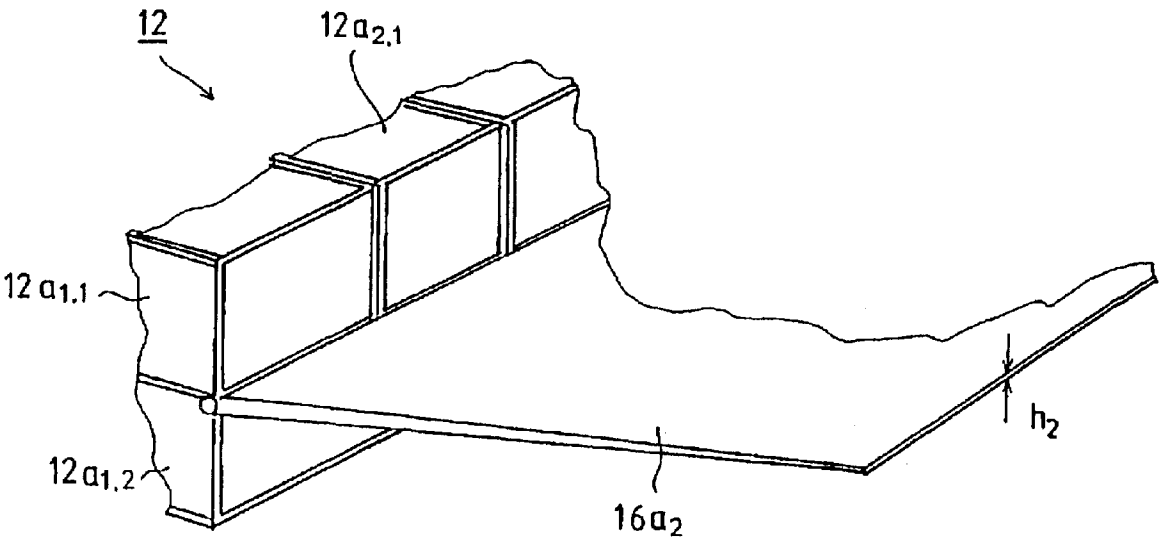
FIG. 7 shows how the lamella is joined to the turbulence generator.

FIG. 7 shows the structure of the lamella according to the invention and how it joins the end face of the outlet end of turbulence generator 12. As can be seen in the figure, the lamella 16$a_1$ narrows in a wedge-like fashion and its ends in a sharp tip 16*b,* the maximum height $h_2$ of which is 2 mm. Preferably there is no step between the lamella 16$a_1$, 16$a_2$ and the end face of the turbulence generator's pipe. If a step occurs, it is no more than 2 mm, that is, equal to the wall thickness of the turbulence generator's pipe.

Figure 8:
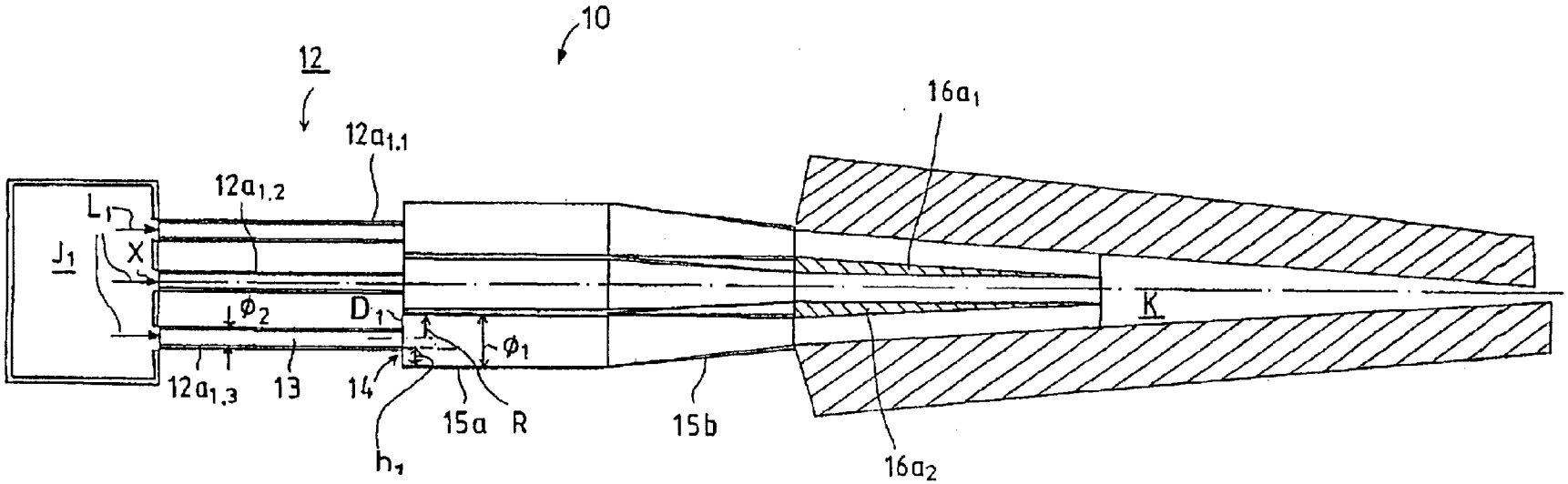
FIG. 8 shows an embodiment of the headbox according to the invention, wherein the pulp is guided from the bypass manifold directly into the turbulence generator according to the invention.

FIG. 8 shows an embodiment of the invention, wherein the headbox of the paper machine includes a bypass manifold $J_1$ and after the bypass manifold a turbulence generator 12 according to the invention. Thus, pulp $M_1$ is conducted as arrows $L_1$ show directly into turbulence generator 12, into the pipes 12$a_{1.1}$, 12$a_{1.2}$ . . . ; 12$a_{2.1}$, 12$a_{2.2}$ . . . of its pipe rows. The turbulence generator 12 includes a structure similar to the one shown in the embodiment of FIGS. 3A, 3B and 3C. Thus, the pulp is conducted into such pipes 12$a_{1.1}$, 12$a_{1.2}$ . . . ; 12$a_{2.1}$, 12$a_{2.2}$ . . . of the turbulence generator's pipe rows, where each pipe includes one fluidisation element or fluidiser 14. The pulp is conducted from bypass manifold $J_1$ first into pipe 11 and then through the radial expansion, that is, the fluidiser, into the pipe 15*a* with a bigger diameter, which includes a part 15*a* having a circular cross-section, which in part 15*b* turns into a narrowing rectangular cross-section. Part 15*b* is the pulp acceleration part, from which the pulp is conducted further into lip chamber K, which includes lamellas 16$a_1$, 16$a_2$, which at their surfaces join the plane of the turbulence generator's end pipes essentially without a step. Thus, after the fluidisation point as little disturbances as possible occur in the flow after the fluidisation point, and the flow is accelerated, so that the residence time of the pulp in the headbox is as short as possible and the pulp is brought with a good fluidisation degree on to the formation wire or formation wires.

Figure 9A:
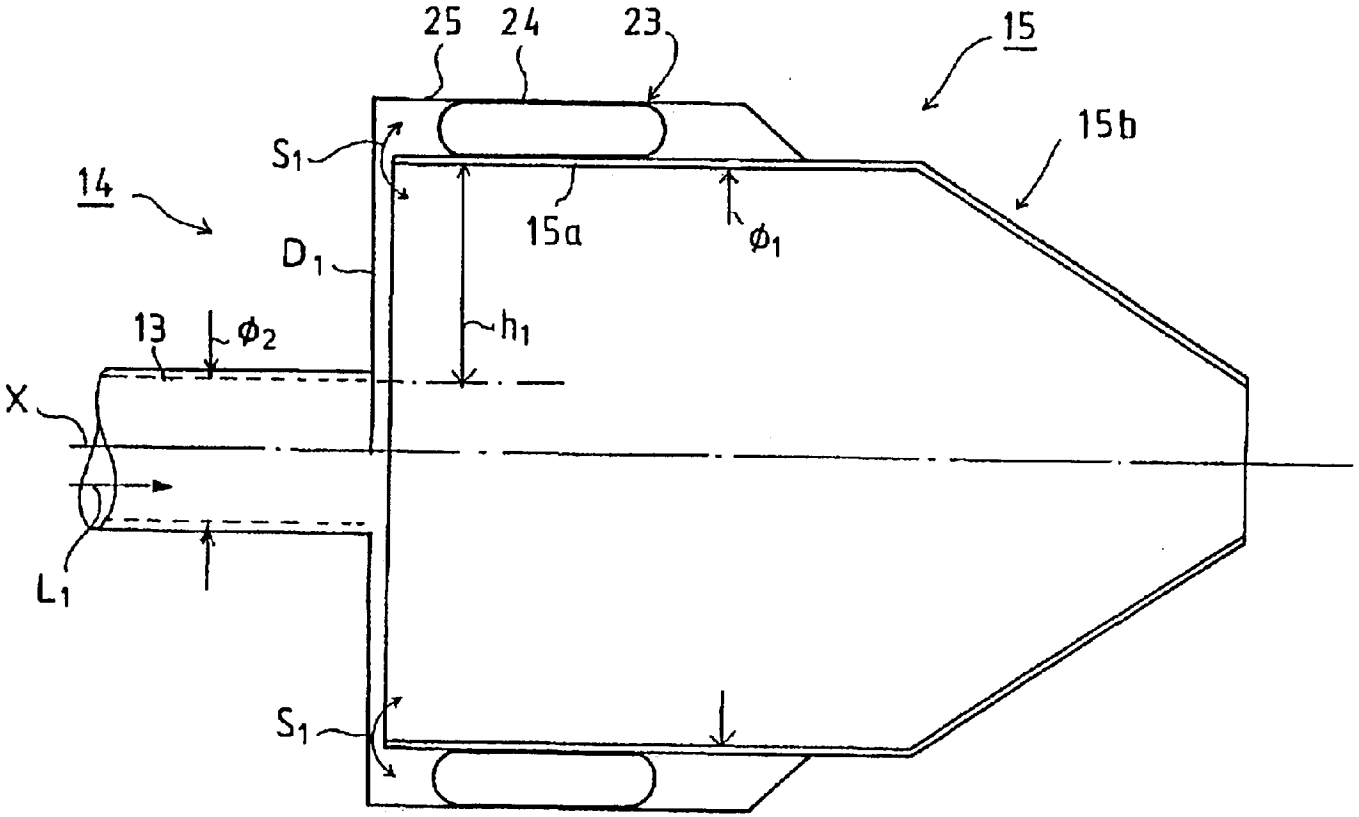
FIG. 9A shows a first advantageous embodiment of control equipment for the fluidiser or fluidisation element.

FIG. 9A shows control equipment 23 according to the invention to control the fluidiser 14, that is, to control the height $h_1$ of the expansion step of fluidisation element 14. In the embodiment shown in FIG. 9A, the structure is otherwise the same as in the previous embodiments, but the end face of pipe part 15*a* of pipe 15 is formed by a bending hose 24. Pressure medium is conducted into the annular hose 24. Hose 24 is located in the space between pipe 15*a* and a sleeve part 25. By supplying pressure into hose 24 the wall 15*a* is bent towards central axis X and the height $h_1$ of the fluidiser's 14 step is reduced, thus reducing the fluidisation power of the fluidiser, that is, of the fluidisation element 14.

Figure 9B:
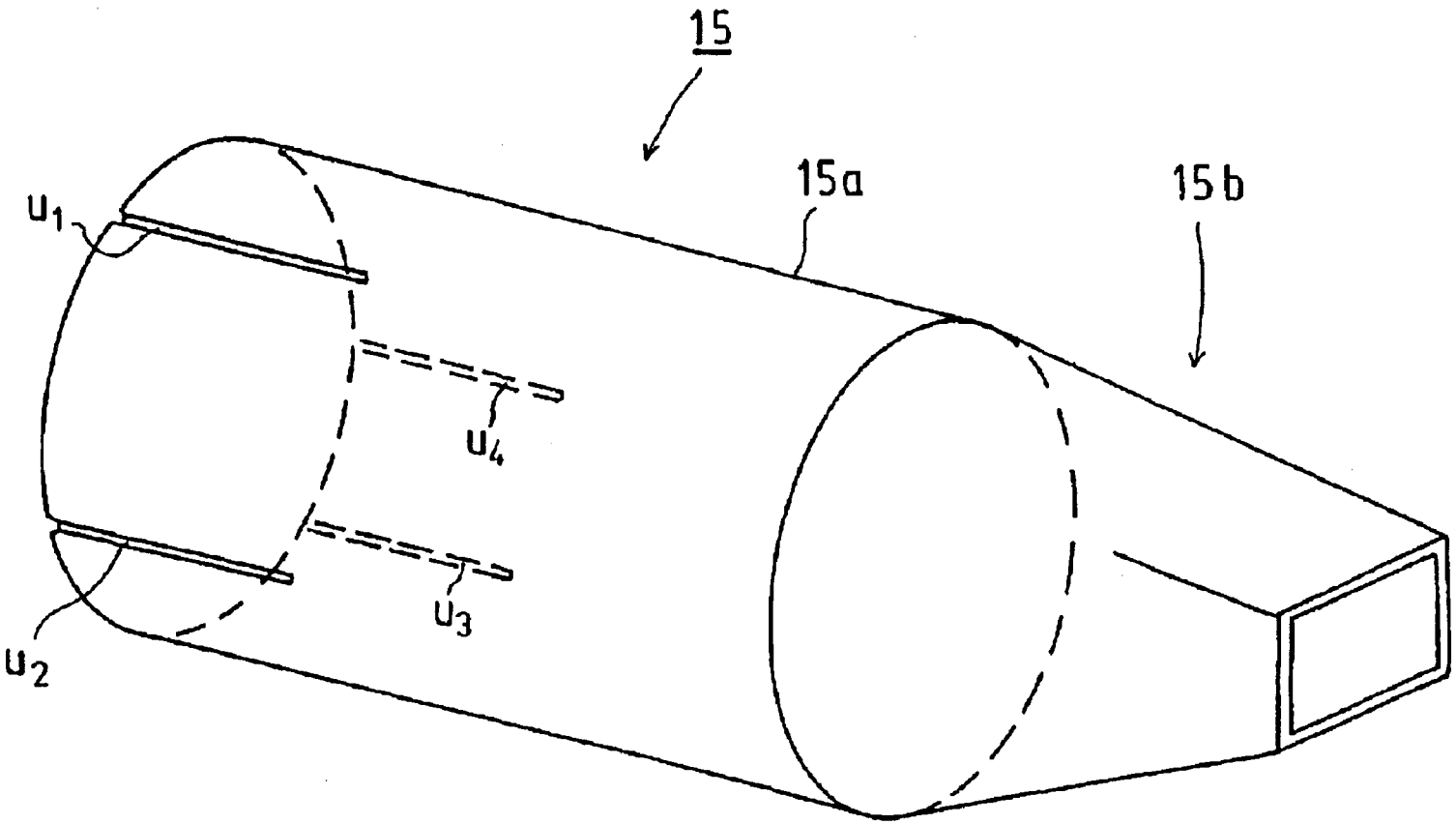
FIG. 9B shows slots in the inlet end of pipe 15 joining the structure shown in FIG. 9A to allow bending of part 15.

FIG. 9B shows slots $U_1$, $U_2$, $U_3$ . . . in the inlet end of pipe 15 joining the structure shown in FIGS. 9A. The inlet end includes slots $U_1$, $U_2$ . . . proceeding in the radial direction, whereby parts in between the slots can be bent towards central axis C. The return motion back to the original position takes place with the aid of the pipe's 15*a* own spring force. The internal pressure in hose 24 is hereby lowered.

Figure 10:
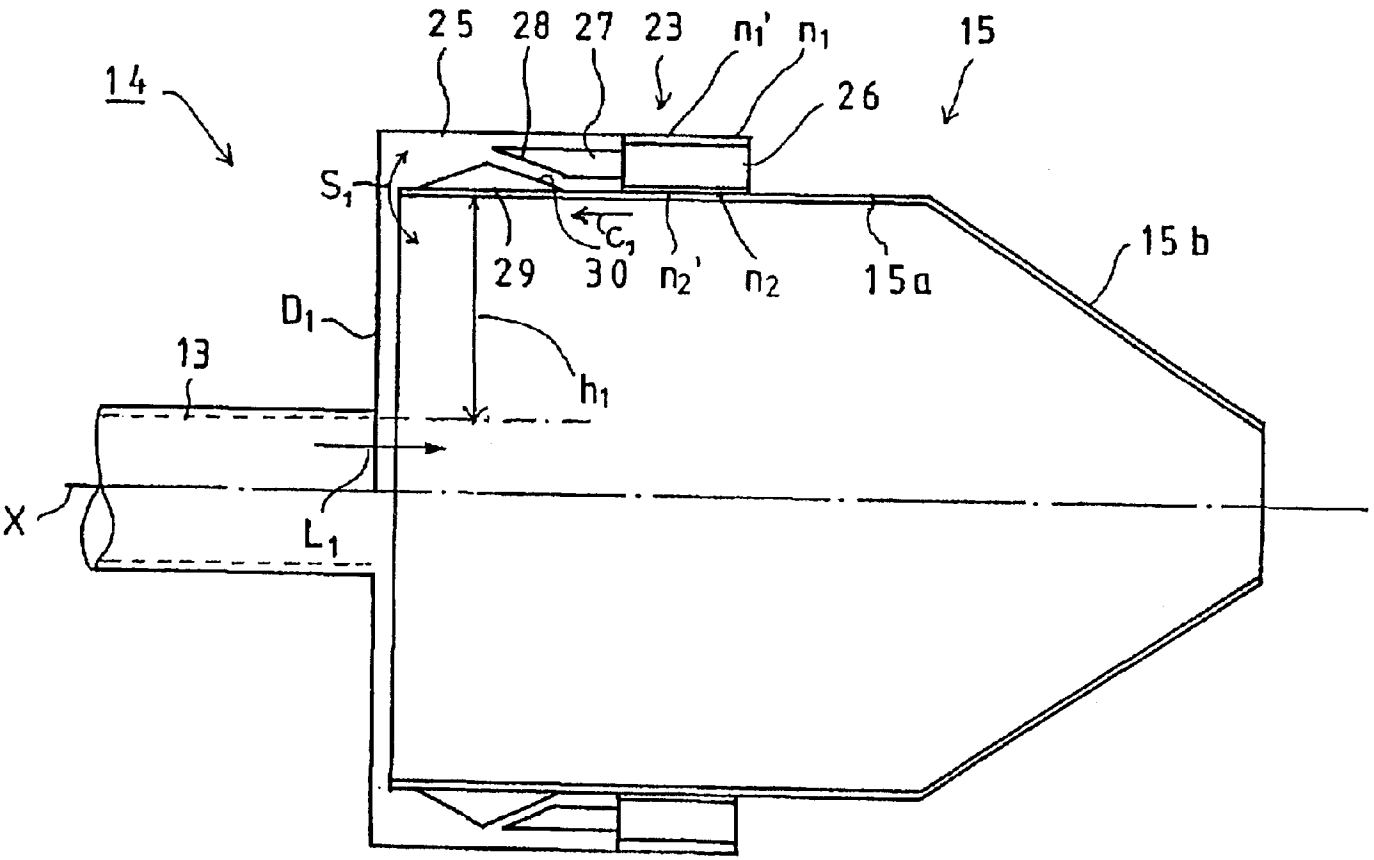
FIG. 10 shows another advantageous embodiment of control equipment for the fluidiser according to the invention, wherein bending of the wall of pipe part 15*a* and thus control of the fluidiser step take place with the aid of wedge pieces.

FIG. 10 shows another embodiment of the control equipment 23 of fluidiser 14. In this embodiment, a nut 26 is mounted in between sleeve 25 and pipe part 15*a* of pipe 15, which nut has both internal and external threads $n_1$, $n_2$, of which the internal threads $n_2$ connect with threads $n_2'$ located outside pipe 15*a* and, correspondingly, the external threads $n_1$ of nut 26 are connected with internal threads $n_i'$ of sleeve 25. By rotating nut 26 it is brought into different positions in the direction of central axis X. Joining the nut 26 is a an annular sleeve 27, which is articulated to rotate in relation to the nut and which includes an internal wedge-like surface 28, which is at an angle to axis X and can be connected to a wedge stop face 30 of a ring 29 located on top of body part 15*a.* Thus, by moving nut 26 in direction $c_1$ the end of pipe's 15*a* inlet side is bent downwards. The return motion takes place with the aid of the pipe's own spring force. In FIG. 10, arrows $S_1$ indicate the control motion and the control of step height $h_1$.

Fluidisation can also be controlled as follows:

the length of throttling pipe 13 is controlled the diameter of throttling pipe 13 before the pipe expansion is controlled control of the position of the pipe expansion in the longitudinal direction.

Figure 11:
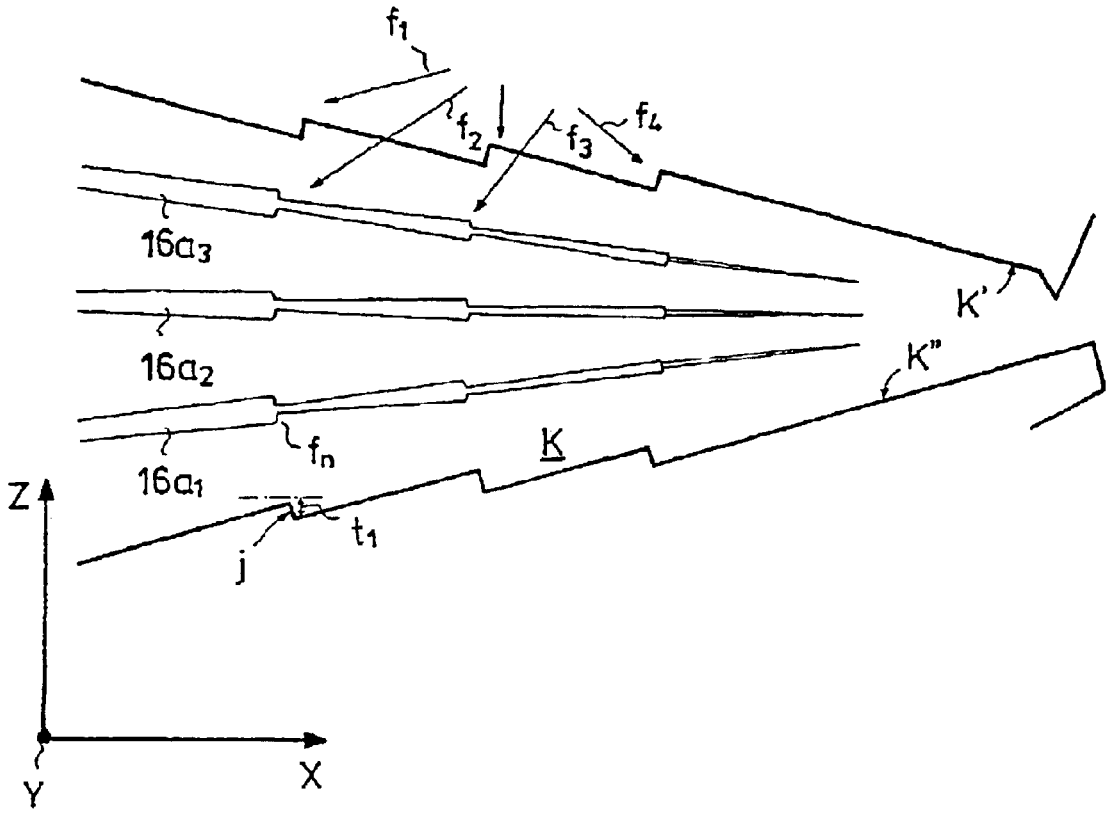
FIG. 11 shows the lip cone of the headbox in a paper machine or such, which lip cone includes forward steps in the lamellas and in the walls of the lip cone.

FIG. 11 shows a lip cone of a headbox in a paper machine or such, which lip cone includes forwards steps in lamellas and in the walls of the lip cone.

The fluidisation level and its maintenance can be affected by producing boundary-layer turbulence on certain conditions.

When the fibre suspension is sufficiently fluidised with a small forward step it is possible to slow down re-flocculation of the fibre suspension, because the flow aims at working loose due to the effect of the small forward step, and thus the boundary layer of the fibre suspension becomes thinner.

FIG. 11 shows the principle of a forward step according to the invention and of its effect on the floc size. The acceleration continuing after the step again causes stabilisation of the boundary layers, whereby the re-flocculation process will again proceed. In FIG. 11, forward steps $f_1$, $f_2$ . . . are located in lamellas 16$a_1$, 16$a_2$ . . . in both their surface sand in walls K' and K" of lip core K. The height $f_1$ of forward stop $f_1$, $f_2$ . . . in direction z is smaller than the average fibre length, the height of forward step $f_1$, $f_2$ being e.g. 0.5 mm–1 mm. The average fibre length is typically 1 mm–3 mm, depending on the pulp used. In the forwards step, step wall j is not against the pulp flow. Forward steps $f_1$, $f_2$ . . . are in lamellas 16$a_1$, 16$a_2$ . . . and/or in the walls K' and K" of lip cone K. A set of coordinates x-y-z is shown in FIG. 11. z is the height direction, x is the machine direction and y is the cross machine direction.

The small forward step allows optimisation of the flow acceleration in the machine direction and thus maximising of the fluidising effect of the boundary layer in the lip channel. When made in the upper and lower lips, the small step makes it possible to change the acceleration step by step, e.g. so that the acceleration is increased most of all close to the lip discharge. By profiling the acceleration in this way in the machine direction the thickness of the boundary layer is affected, among other things, and thus its power to produce a boundary-layer turbulence maintaining fluidisation is affected.

The headbox according to the invention may be used not only in a paper machine but also in board machines, soft tissue machines and pulp drying machines.

What is claimed is:

1. A method for fluidization of pulp flow in a headbox of a paper machine comprising the steps of:

causing pulp to flow from a manifold through, a turbulence generator defined by a plurality of first pipes, wherein each first pipe has a first inside diameter and is joined by a fluidizer step to a second pipe which is concentric with the first pipe to which it is joined, each second pipe having a second inner diameter, wherein the ratio between the inner diameters of the second pipes and the inner diameters of the first pipes is in the range of 1.1 to 4, and wherein the pulp contains fibers which define an average length between one and three millimeters, and wherein the pulp is caused to flow from the first pipes to the second pipes and into a lip cone, and from the lip cone to a former;

wherein each fluidizer step has a height, and wherein the height is defined as one half of the quantity of the second inside diameter less the first inside diameter, said height being at least equal to said average length of the fibers; and wherein fluidization takes place only at the fluidizer step, and all step expansions between the fluidizer step and a lip opening of the lip cones extend in a z direction less than the average length of the fibers.

2. The method of claim 1 wherein, after the fluidizer step, the pulp flow speed is accelerated essentially all the way to the lip opening.

3. The method of claim 1 wherein the pulp flow in the turbulence generator is brought to the lip cone and to lamellas located therein, so that the flow from the second pipes of the turbulence generator is conducted so that no disturbance is caused to the flow, thereby the pulp flow from the turbulence generator arrives from inside boundary surfaces of the turbulence generator's second pipes on to surfaces defined by the lamellas without any steps, because the surfaces of the lamellas are arranged at the same level with end surfaces of the outlet ends of the turbulence generator's pipes.

4. The method of claim 3 wherein the lamellas narrow in a wedge-like fashion toward a sharp tip in the direction of the lip opening.

5. The method of claim 1 wherein as the flow arrives from the first pipe with a smaller diameter to the second pipe with a bigger diameter the pulp caused to flow in the expanding step travels in a radial direction to the expanding point and meets the internal surface of the pipe part having a circular cross section.

6. The method of claim 1 wherein control equipment is used to control the height of the fluidizer steps.

7. The method of claim 6 wherein the control equipment is used for moving a wall portion of the second pipe adjacent a fluidizer step in order to control the fluidization degree of the turbulence generator.

8. The method of claim 1 wherein after the pulp flow leaves the turbulence generator, the pulp flow encounters forward steps in the lamellas and wherein the height of the forward steps in a z direction is smaller than the average fibre length.

9. The method of claim 1 wherein after the pulp flow leaves the turbulence generator, the pulp flow encounters forward steps in the walls of the lip cone, and wherein the height of the forward steps in the z direction is smaller than the average fibre length.

10. The headbox of claim 1 wherein a cross-sectional area is defined at each point in the headbox between the turbulence generator and a lip opening of the lip cone, and wherein the cross-sectional area continuously decreases as the lip opening is approach so that the pulp flow accelerates the essentially all the time all the way to lip opening.

11. A headbox of a papermaking machine comprising:

a pulp flow manifold;

a lip cone;

a turbulence generator extending between the pulp flow manifold and the lip cone, the turbulence generator being comprised of a plurality of first pipes, having first inside diameters, each first pipe terminating in an annular wall structure, which extends at least to an inner surface of a second pipe which has a circular cross-section, the second pipe being coaxial with the first pipe and having an inside diameter of the inner surface of the second pipe which is greater than the first inside diameter;

wherein the second pipe has a part with a circular cross-section which together with the annular wall structure defines a fluidizer expansion step having a radial height defined between the inside diameter of the first pipe and the inside diameter of the second pipe along the annular wall structure; and control equipment including an actuator which moves the second pipe part having a circular cross-section to control the height of the fluidizer expansion step.

12. The headbox of claim 11 wherein the control equipment includes a nut which turns on an outside threads on the second pipe, whereby the nut can be moved in a direction defined a long a central axis of the second pipe, the nut having a sleeve part and therein a wedge-like stop face which can be connected to a wedge surface of a ring located on an external surface of the second pipe part wherein by turning the nut the height the height of the fluidizer expansion step can be controlled.

13. The headbox of claim 11 wherein the second pipe part having a circular cross-section has portions defining slots which allow radial inward bending of the pipe part.

14. A headbox of a papermaking machine comprising:

a pulp flow manifold;

a lip cone;

a turbulence generator extending between the pulp flow manifold and the lip cone, the turbulence generator being comprised of a plurality of first pipes, having first inside diameters each first pipe terminating in an annular wall structure which extends at least to an inner surface of a second pipe which has a circular cross-section, the second pipe being coaxial with the first pipe and having a inside diameter of an inner surface of the second pipe which is greater than the first inside diameter by a ratio between 1.1 and 4;

wherein the second pipe has a part with a circular cross-section, which has axially extending slots, the part, together with the annular wall structure defining a fluidizer expansion step having a radial height defined between the inside diameter of the first pipe and the inside diameter of the second pipe along the annular wall structure;

wherein the radial height is greater than one millimeter; and an actuator which moves the second pipe part having a circular cross-section inwardly to control the height of the fluidizer expansion step.

15. The headbox of claim 14 wherein between the turbulence generator and a lip opening of the lip cone the pulp flow encounters forward steps in the lamellas and wherein the height of the forward steps in a z direction is smaller than the lesser of 3 mm of the fluidizer expansion step radial height.

16. The headbox of claim 14 wherein between the turbulence generator and a lip opening of the lip cone the pulp flow encounters forward steps in the walls of the lip cone, and wherein the height of the forward steps in a x direction is smaller than the lesser of 3 mm of the fluidizer expansion step radial height.

* * * * *

UNITED STATES PATENT AND TRADEMARK OFFICE

CERTIFICATE OF CORRECTION

PATENT NO. : 6,875,312 B2
DATED : April 5, 2005
INVENTOR(S) : Hannu Lepomäki et al.

It is certified that error appears in the above-identified patent and that said Letters Patent is hereby corrected as shown below:

Column 1,
Line 34, “may be” should be -- made by --

Column 2,
Line 27, “can can” should be -- can --

Column 3,
Line 9, “penetrations” should be -- presentations --
Line 25, “lie” should be -- line --

Column 4,
Line 33, “up the” should be -- up with the --
Line 60, “will” should be -- with --

Column 5,
Line 53, “3A, and” should be -- 3A, pulp --

Column 8,
Line 40, “$n_l$’” should be -- $n_1$’ --

Column 9,
Line 36, “through,” should be -- through --
Line 56, “cones” should be -- cone --

Column 12,
Line 18, “x” should be -- z --
Line 19, “of” should be -- or --

Signed and Sealed this

Ninth Day of August, 2005

JON W. DUDAS
*Director of the United States Patent and Trademark Office*